United States Patent [19]

Spalding

[11] 4,413,383

[45] Nov. 8, 1983

[54] BUCKLES FOR HARNESSES

[75] Inventor: David N. Spalding, Woking, England

[73] Assignee: Britax-Excelsior Limited, Byfleet, England

[21] Appl. No.: 171,216

[22] Filed: Jul. 22, 1980

[30] Foreign Application Priority Data

Jul. 28, 1979 [GB] United Kingdom ..... 7926379

[51] Int. Cl.[3] ..... A44B 11/00; A44B 13/00

[52] U.S. Cl. ..... 24/164; 24/165; 24/579

[58] Field of Search ..... 24/164, 163 R, 165, 24/201 HH, 201 HE

[56] References Cited

U.S. PATENT DOCUMENTS

| | | | |
|---|---|---|---|
| 1,126,610 | 1/1915 | Woolf | 24/201 HH |
| 2,165,928 | 7/1939 | Krischer | 24/201 HH |
| 3,765,062 | 10/1973 | Cruse | 24/201 HH |

FOREIGN PATENT DOCUMENTS

| | | | |
|---|---|---|---|
| 1557519 | 4/1970 | Fed. Rep. of Germany . | |
| 2080179 | 11/1971 | France . | |
| 2093131 | 1/1972 | France . | |
| 936375 | 9/1963 | United Kingdom | 24/165 |

*Primary Examiner*—Victor N. Sakran

*Attorney, Agent, or Firm*—Strimbeck, Davis & Soloway

[57] ABSTRACT

A buckle for a safety harness consists of two identical parts. Each part comprises a plate 10 having a D-shaped aperture 12 in one end, for receiving a harness, and a portion 14 at the other end folded at right angles to the rest of the plate 10 along an oblique fold line 16. A slot 18 extends half way along the fold line 16. A second plate 20 has a tab 22 welded to the portion 14 of the plate 10 at the side thereof adjacent to the slot 18. The two parts interlock with the upstanding portions 14 and 22 of one part projecting through the slot 18 in the other and vice versa. Tension applied to a harness connected to the apertures 12 tends to draw the ends 24 of the slots 18 into abutment with each other.

1 Claim, 4 Drawing Figures

BUCKLES FOR HARNESSES

This invention relates to a buckle for a safety harness.

According to the invention, a buckle of the foregoing type is formed in two identical parts, each comprising a plate having a means for connection to a harness strap at one end and an upstanding portion at its other end folded at right angles along an oblique fold line, a slot being cut in the plate from the end of the fold line nearer to the harness aperture to the mid point of the fold line, and the upstanding end portion having a protuberance on the side thereof remote from the harness aperture to provide an abutment surface on the level of the plate on the inside of the fold line, whereby, if the two parts are interengaged with each upstanding end portion received in the oblique slot of the other part, tension applied to the harness apertures pulls the two parts so that the ends of their slots abut.

Preferably, each upstanding end portion has a hole extending therethrough with its axis aligned with the end of the slot in the corresponding plate whereby, when the two parts are interengaged, the two holes in the upstanding end portions are aligned with one another to permit an object to be inserted therethrough to lock the two parts in engagement with one another.

The object inserted through the holes may be a carabiner or snap-link for connecting the buckle to a lifeline.

An embodiment of the invention is illustrated in the accompanying drawings, in which.

Figure 1:
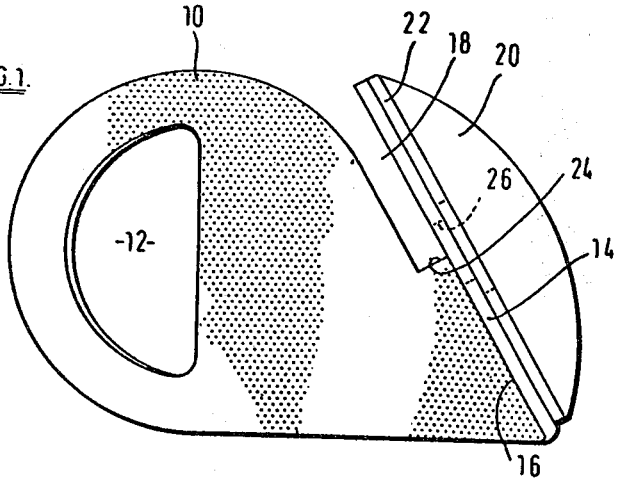
FIG. 1 is a plan view of the one part of a buckle.
Figure 2:
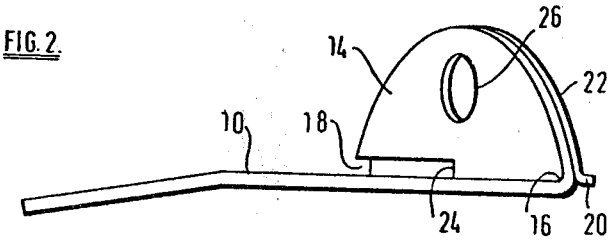
FIG. 2 is a side elevation of the buckle part shown in FIG. 1.
Figure 3:
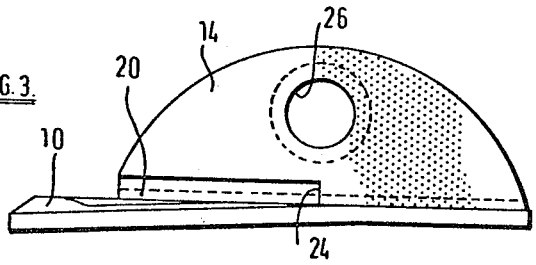
FIG. 3 is an oblique elevation of the buckle part shown in FIG. 1.

Referring to FIGS. 1 to 3, one part of a buckle comprises a plate 10 having a D-shaped aperture 12 in one end for receiving a harness.

A portion 14 at the other end of the plate 10 is folded at right angles to the rest of the plate 10 along an oblique fold line 16. A slot 18 extends half way along the fold line 16 from the end therefore nearer to the aperture 12. A second plate 20 has a tab 22 bent at right angles thereto and welded to the portion 14 of the plate 10 at the side thereof adjacent to the slot 18 so that the bottom of the plate 20, as viewed in FIGS. 2 and 3, is level with the top of the plate 10.

Figure 4:
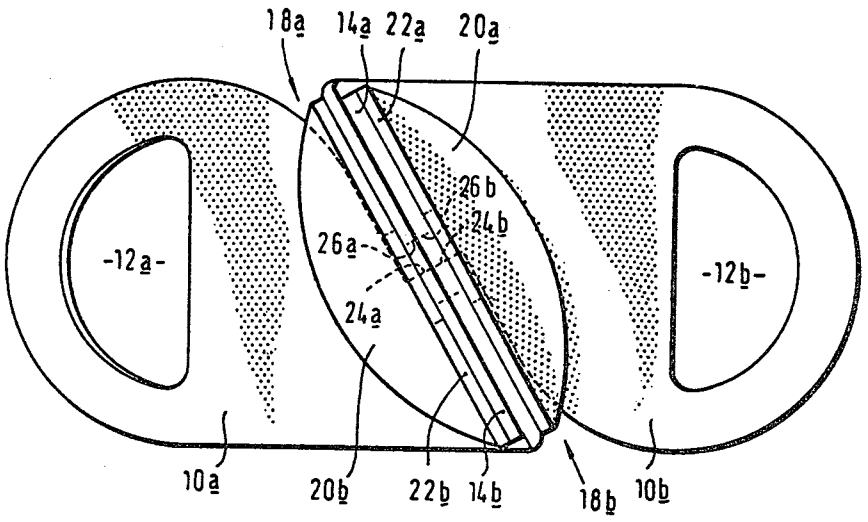
FIG. 4 is a plan view showing two identical buckle parts engaging with one another.

Turning now to FIG. 4, two identical buckle parts are shown in engagement with one another. The various component parts are denoted by the same reference numerals as are used in FIGS. 1 to 3 with the suffix "a" for one part of the buckle and the suffix "b" for the other. The upstanding portions 14*a* and 22*a* project through the slot 18*b* and vice versa. Tension applied to a harness connected to the apertures 12*a* and 12*b* tends to draw the two buckle parts apart so that the ends 24*a* and 24*b* of the slots 18*a* and 18*b* are brought into abutment with each other. Holes 26*a* and 26*b* in the upstanding positions 14*a* and 14*b* are then in alignment with each other. If a snap link (not shown) is inserted through the holes 26*a* and 26*b*, the two parts of the buckle are prevented from separating from one another.

I claim:

1. A buckle for a safety harness formed of first and second interlocking parts, wherein the first and second parts are identical and each part comprises a plate having means for connection to a harness strap at one end, an upstanding portion at its other end folded at right angles along an oblique fold line, a slot dimensioned to receive the upstanding portion of the other part extending from the end of the fold line nearer to the harness aperture to the mid point of the fold line, a protuberance on the side of the upstanding end portion remote from the harness connection means to provide an abutment surface on the level of the plate on the inside of the fold line and a hole through said upstanding end portion with its axis aligned with the end of the slot at the midpoint of the fold line whereby, if the two parts are interengaged with each upstanding portion received in the oblique slot of the other part, tension applied to the harness apertures pulls the two parts so that the ends of their slots abut and the two holes in the upstanding end portions are aligned with one another to permit an object to the inserted therethrough to lock the two parts in engagement with one another.

* * * * *